US008855342B2

(12) United States Patent
Kornagel

(10) Patent No.: US 8,855,342 B2
(45) Date of Patent: Oct. 7, 2014

(54) HEARING AID DEVICE FOR FREQUENCY COMPRESSION

(75) Inventor: Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 304 days.

(21) Appl. No.: 13/248,165

(22) Filed: Sep. 29, 2011

(65) Prior Publication Data

US 2012/0106762 A1 May 3, 2012

Related U.S. Application Data

(60) Provisional application No. 61/387,519, filed on Sep. 29, 2010.

(51) Int. Cl.
*H04R 25/00* (2006.01)

(52) U.S. Cl.
CPC ..... *H04R 23/353* (2013.01); *H04R 2430/03* (2013.01)
USPC ..... 381/316; 381/320

(58) Field of Classification Search
CPC ..... H04R 25/353; H04R 2225/43; H04R 2430/03
USPC ..... 381/316, 318, 320, 321, 317, 60, 98, 381/94.2, 94.3, 106
See application file for complete search history.

(56) References Cited

U.S. PATENT DOCUMENTS

| | | | | |
|---|---|---|---|---|
| 3,385,937 | A | 5/1968 | Lafon | |
| 5,838,801 | A | 11/1998 | Ishige et al. | |
| 7,248,711 | B2 * | 7/2007 | Allegro et al. | 381/316 |
| 8,031,892 | B2 | 10/2011 | Andersen et al. | |
| 8,045,739 | B2 | 10/2011 | Paludan-Mueller et al. | |
| 2004/0006956 | A1 | 1/2004 | Steigert | |
| 2007/0253585 | A1 | 11/2007 | Steinbuss | |
| 2010/0198603 | A1 * | 8/2010 | Paranjpe | 704/500 |
| 2011/0150256 | A1 * | 6/2011 | Baechler et al. | 381/316 |

FOREIGN PATENT DOCUMENTS

| | | | |
|---|---|---|---|
| DE | 1261169 | B | 2/1968 |
| DE | 102006019728 | A1 | 11/2007 |
| JP | 57055700 | A | 4/1982 |
| JP | 10174195 | A | 6/1998 |
| JP | 4017520 | B2 | 12/2007 |
| JP | 2008544660 | A | 12/2008 |
| JP | 2009507407 | A | 2/2009 |
| WO | 0075920 | A1 | 12/2000 |

* cited by examiner

*Primary Examiner* — Fan Tsang
*Assistant Examiner* — Eugene Zhao
(74) *Attorney, Agent, or Firm* — Laurence A. Greenberg; Werner H. Stemer; Ralph E. Locher

(57) ABSTRACT

With a hearing aid device suitable for executing a frequency compression, the aim is for different input signals entering the hearing aid device to be easily distinguishable even after frequency compression. To this end it is proposed that form factors should be determined from source frequency bands in which the signal components of the input signal present therein are not included in the output signal, these being included in the amplification of selected frequency bands, the signal components of which are included in the output signal.

8 Claims, 2 Drawing Sheets

HEARING AID DEVICE FOR FREQUENCY COMPRESSION

CROSS-REFERENCE TO RELATED APPLICATION

This application claims the priority, under 35 U.S.C. §119 (e), of provisional application No. 61/387,519, filed Sep. 29, 2010; the prior application is herewith incorporated by reference in its entirety.

BACKGROUND OF THE INVENTION

Field of the Invention

The invention relates to a method for frequency compression of an input signal entering a hearing aid device and includes the below described steps.

A frequency range that can be transmitted by the hearing aid device can be split into a number of frequency bands. A number of adjacent frequency bands are combined into at least one group of frequency bands. One of the frequency bands is selected from the group of frequency bands and the selected frequency band is moved into a target frequency band.

The invention also relates to a hearing aid device for performing such a method.

To compensate for a user's individual hearing loss, frequency-dependent amplification of an input signal entering the hearing aid device normally takes place in the hearing aid device. The dynamic range, i.e. the range between the hearing threshold and the discomfort threshold, is generally very limited for a hearing-impaired person compared with a person with normal hearing. Therefore modern hearing aid devices generally also perform dynamic compression by an automatic amplification or gain control AGC.

However there are hearing losses which cannot be compensated for in a satisfactory manner by simple frequency-dependent amplification of an acoustic input signal. Examples of this are hearing losses with dead frequency ranges, in which spectral components of the acoustic input signal cannot be made audible even with a high level of amplification.

German patent application DE 10 2006 019 728 A1 discloses a method for adjusting a hearing aid apparatus, in which a portion of an input signal spectrum at a first frequency is amplified and shifted to a second frequency as a function of time, in order on the one hand to achieve a high level of spontaneous acceptance of the hearing system due to an almost undistorted sound pattern of the hearing system between two adaptation steps and on the other hand to assist the learning and acclimatization process of the hearing-impaired person in respect of the new frequency pattern.

One possibility for resolving the last-mentioned problem is what is known as frequency compression. Here spectral components within a source spectral range (typically at higher frequencies) are shifted to a target frequency range (typically at lower frequencies). Unlike the signal components of the acoustic input signal in the source frequency range, the signal components shifted to the target frequency range can be made audible by amplification in this frequency range.

One possible frequency compression method contains the now described method steps.

A frequency range that can be transmitted by the hearing aid device is split into a number of frequency bands (channels). A number of adjacent frequency bands are combined into at least one group of frequency bands. One of the frequency bands is selected from the group of frequency bands. The selected frequency band is moved to a target frequency band. Optionally the frequency bands from the group of frequency bands that are not selected are suppressed.

One disadvantage of this procedure is however that sound signals which mainly differ in the content of the channels not selected are difficult to distinguish or can no longer be distinguished after frequency compression.

SUMMARY OF THE INVENTION

It is accordingly an object of the invention to provide a hearing aid device for frequency compression which overcomes the above-mentioned disadvantages of the prior art devices of this general type, which makes it easier to distinguish sound signals which mainly differ in the content of the channels not selected.

With the foregoing and other objects in view there is provided, in accordance with the invention a method for frequency compression of an input signal entering a hearing aid device. The method includes the steps of: splitting a frequency range that can be transmitted by the hearing aid device into a number of frequency bands; combining a number of adjacent frequency bands into at least one group of frequency bands; selecting one frequency band from the group of frequency bands; moving a selected frequency band to a target frequency band; and amplifying a signal component of an input signal lying in the selected frequency band or of a signal originating from the signal component in dependence on a further signal component of a further input signal from at least one frequency band of the group of frequency bands that is not selected.

The object is achieved with a frequency compression method of the type mentioned in the introduction, in that a signal component of the input signal lying in the selected frequency band or a signal originating from the signal component is amplified in dependence on signal components in frequency bands of the group of frequency bands that have not been selected.

By determining the amplification in dependence on the signal components in the frequency bands that are not selected, the suppressed frequency bands (in other words: the signal components of the input signal in the frequency bands that are not selected) within a group of frequency bands are also still taken into account to a certain extent in the target frequency band of the group. If the group of suppressed frequency bands contains a large measure of sound energy, this results in a comparatively high level of amplification for the selected frequency band of the group in the target frequency band. In contrast in another group of frequency bands, in which the suppressed frequency bands only have a small measure of sound energy, the signal moved from the selected frequency band to the associated target frequency band is amplified or attenuated to a correspondingly smaller degree. The invention therefore brings about a different weighting of the signal components moved to the individual target frequency bands, with the signal components of the input signal in the suppressed frequency bands also being included in this weighting. This allows sound signals, which mainly differ in the suppressed frequency bands, to be more easily distinguished.

Amplification of the signal component of the input signal in the selected frequency band can take place either before the move to the target frequency band or after the move, in other words after the frequency shift. In this process the amplification for specific selected frequency bands can also be less than 1, i.e. an attenuation, in the context of the invention.

According to the invention a signal component of the input signal lying in the selected frequency band or a signal originating from the signal component is amplified in dependence on a signal component of the input signal from at least one frequency band of the group of frequency bands that is not selected. However the signal components of a number of frequency bands that are not selected, preferably the signal components of all the frequency bands that are not selected, are advantageously included in the amplification calculation.

In one preferred embodiment of the invention a form factor F is determined, which is a function of the spectral content of all the frequency bands within a group of frequency bands. The richer the input signal is in spectral terms within a specific group of frequency bands, the greater the form factor of the group. The form factor acts as an amplification factor, applied to the selected frequency band within a group of frequency bands or the relevant target frequency band. The signal component of the input signal in the selected frequency band or the signal moved to the relevant target frequency band is advantageously multiplied by the form factor.

There are a plurality of different possibilities for determining the form factor, which are suitable for performing the inventive method.

According to a first variant of the invention a form factor FA is calculated from the quotient of the sum of the magnitudes of the signals of all the frequency bands of a group and the magnitude of the signal of the selected frequency band:

$$FA = \frac{\text{Sum of the magnitudes of the signals of all the frequency bands of a group}}{\text{Magnitude of the signal of the selected frequency band}}. \quad \text{(E1)}$$

According to a second variant of the invention a form factor FB is calculated from a quotient of the sum of the squares of the magnitudes of the signals of all the frequency bands of a group and the square of the magnitude of the signal of the selected frequency band:

$$FB = \frac{\text{Sum of the squares of the magnitudes of the signals of all the frequency bands of a group}}{\text{Square of the magnitude of the signal of the selected frequency band}}. \quad \text{(E2)}$$

According to a third variant of the invention a form factor FC is calculated in the same way as the form factor FA, with the difference from FA that for FC the sum of the magnitudes of the signals of all the frequency bands is standardized to the number of frequency bands of the relevant group:

$$FC = \frac{\text{Sum of the magnitudes of the signals of all the frequency bands of a group}}{(\text{Number of frequency bands}) \cdot (\text{Magnitude of the signal of the selected frequency band})}. \quad \text{(E3)}$$

According to a fourth variant of the invention a form factor FD is calculated in the same way as the form factor FB, with the difference from FB that for FD the sum of the squares of the magnitudes of the signals of all the frequency bands is standardized to the number of frequency bands of the relevant group:

$$FD = \frac{\text{Sum of the squares of the magnitudes of the signals of all the frequency bands of a group}}{(\text{Number of frequency bands}) \cdot \left(\begin{array}{c}\text{Square of the magnitude of the signal}\\ \text{of the selected frequency band}\end{array}\right)}. \quad \text{(E4)}$$

The invention is not restricted to the calculation methods cited by way of example for the form factors FA to FD. Instead a plurality of further possibilities is conceivable for determining the form factor. In particular multiplication by constants and/or further variables can be included in the form factors cited by way of example. It is furthermore possible—unlike in the above examples—for the signals of all the frequency bands of the respective group not always to be included in the respective counter calculation. In particular it is possible for the signal in the respectively selected frequency band not to be included in the calculation of the form factor.

Other features which are considered as characteristic for the invention are set forth in the appended claims.

Although the invention is illustrated and described herein as embodied in a hearing aid device for frequency compression, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
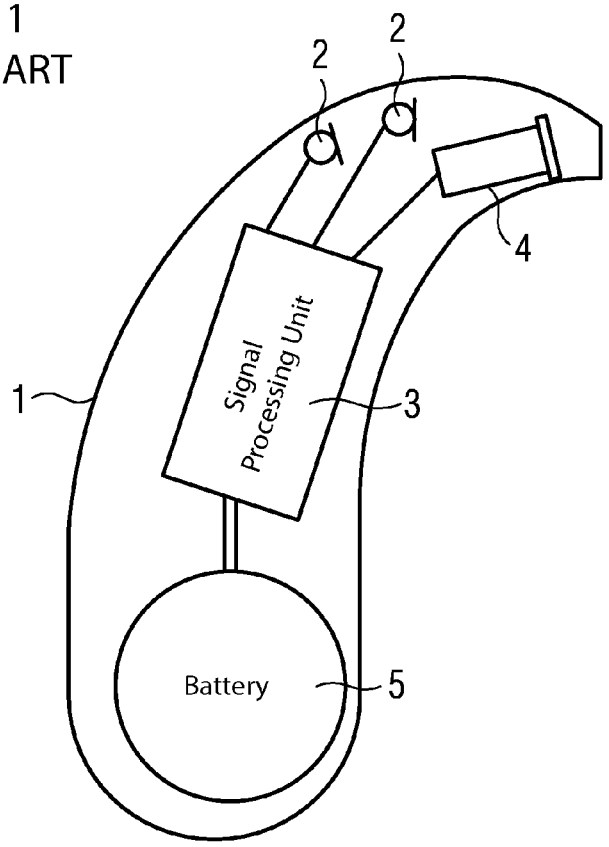
FIG. 1 PRIOR ART
FIG. 1 is a simplified block circuit diagram of a hearing device according to the prior art.

FIG. 1 shows a highly simplified block circuit diagram of an example of the structure of a hearing aid device, in particular a hearing device that can be worn behind the ear, according to the prior art. The key components of hearing devices are essentially an input transducer 2, an amplifier and an output transducer 4. The input transducer 2 is generally a sound receiver, e.g. a microphone, and/or an electromagnetic receiver, e.g. an induction coil. The output transducer 4 is generally in the form of an electroacoustic transducer, e.g. a miniature loudspeaker or earpiece, or an electromechanical transducer, e.g. a bone conduction earpiece. The amplifier is generally integrated in a signal processing unit 3. In the exemplary embodiment according to FIG. 1 one or more microphones 2 for picking up sound from the environment are incorporated in a hearing device housing 1 to be worn behind the ear. The signal processing unit 3, which is likewise located in the hearing device housing 1, processes the microphone signals and amplifies them. The output signal of the signal processing unit 3 is transmitted to a loudspeaker or earpiece 4, which outputs an acoustic signal. The sound is optionally transmitted by way of a sound tube, which is fixed in the auditory canal by an otoplastic, to the eardrum of the user. Energy is supplied to the hearing device and in particular to the signal processing unit 3 by a battery 5 likewise disposed in the hearing device housing 1.

Figure 2:
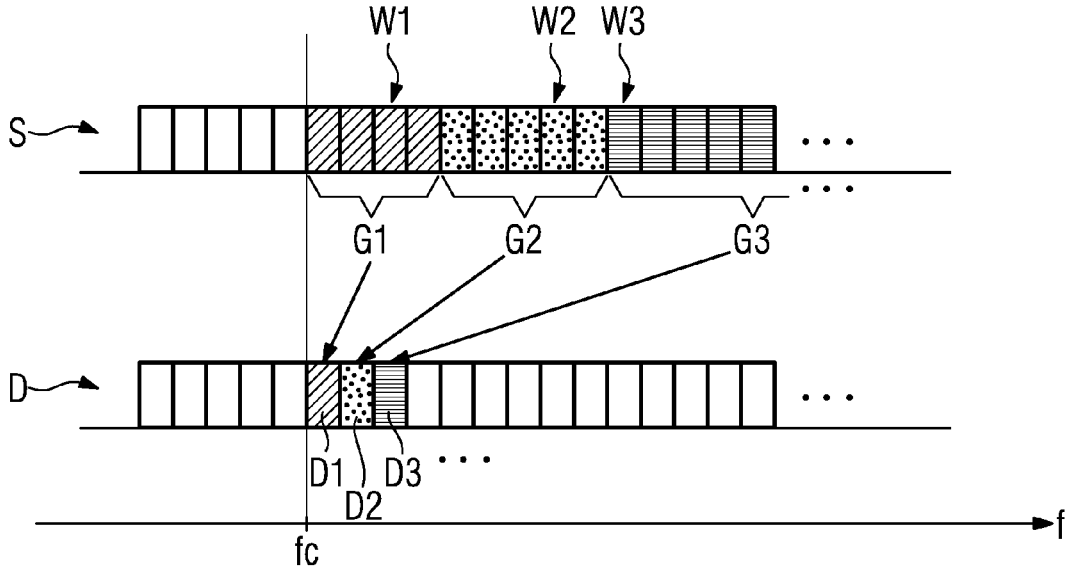
FIG. 2 is a diagram showing a division of a number of frequency bands into different groups of frequency bands, a selection of a selected frequency band from each group of frequency bands and a movement of a respectively selected frequency band in each instance to a target frequency band assigned to a relevant group according to the invention.

FIG. 2 shows the splitting of the frequency range that can be transmitted by a hearing aid device into a plurality of frequency bands. In the exemplary embodiment a width of the frequency bands is the same for all frequency bands (e.g. 200 Hz), which does not necessarily have to be the case. During frequency compression one source frequency range S is generally mapped or moved to a target frequency range D. Below a certain threshold frequency $f_c$ no frequency compression takes place in the exemplary embodiment and above the threshold frequency $f_c$ a certain number of adjacent frequency bands are combined in each instance into a group of frequency bands. In the exemplary embodiment this is shown for groups G1, G2 and G3. The number of frequency bands within a group can vary between groups. Just one target frequency band D1, D2, D3, etc. is assigned to each group of frequency bands G1, G2, G3, etc. A certain frequency band (the "winning frequency band") is selected from each group of frequency bands G1, G2, G3, etc.—e.g. for a certain time period—for example the frequency band, in which the signal component of the input signal has the highest signal level compared with the signal components in the other frequency bands of the group, and shifted to the target frequency band assigned to the group. In the exemplary embodiment the winning frequency bands W1, W2 and W3 were selected, as shown, and shifted to the frequency bands D1, D2 and D3. The other frequency bands of each group, i.e. those that were not selected, are not mapped to another frequency range and are therefore suppressed, at least from the point of view of the hearing-impaired user. Optionally frequency bands that are not selected and are therefore suppressed can also be actively suppressed, in other words attenuated or filtered out by a filter device in the hearing aid device in respect of the input signal. It is also possible for signal components of the input signal to be suppressed in the output signal of a relevant hearing aid device, in that no further signal processing takes place for the relevant signal components after splitting into frequency bands.

Generally the signal component shifted from the selected frequency band W1, W2, W3 to the target frequency band is overlaid on the signal component of the input signal that is present anyway in the target frequency band. This can be done by simply adding the two signals but it is also possible to set a certain mixing ratio or different weighting of the signals. This can even mean that for example the signal component resulting directly from the input signal is totally suppressed (filtered out) in the relevant frequency band and only the signal shifted out of another frequency band to the relevant frequency band is processed further.

According to the invention a form factor is advantageously determined from all the frequency bands of a group and the relevant form factor is applied to the selected frequency band of the group. For example the signal component of the input signal lying in the selected frequency band is multiplied by the form factor, thereby bringing about amplification or attenuation of the signal component. The form factor is in particular a measure of the sound energy of all the channels of the relevant group. Since the form factors resulting from the individual groups of frequency bands generally differ, this results in a different weighting of the frequency bands selected in each instance from the individual groups of frequency bands or of the signal components of the input signal in these frequency bands.

Figure 3:
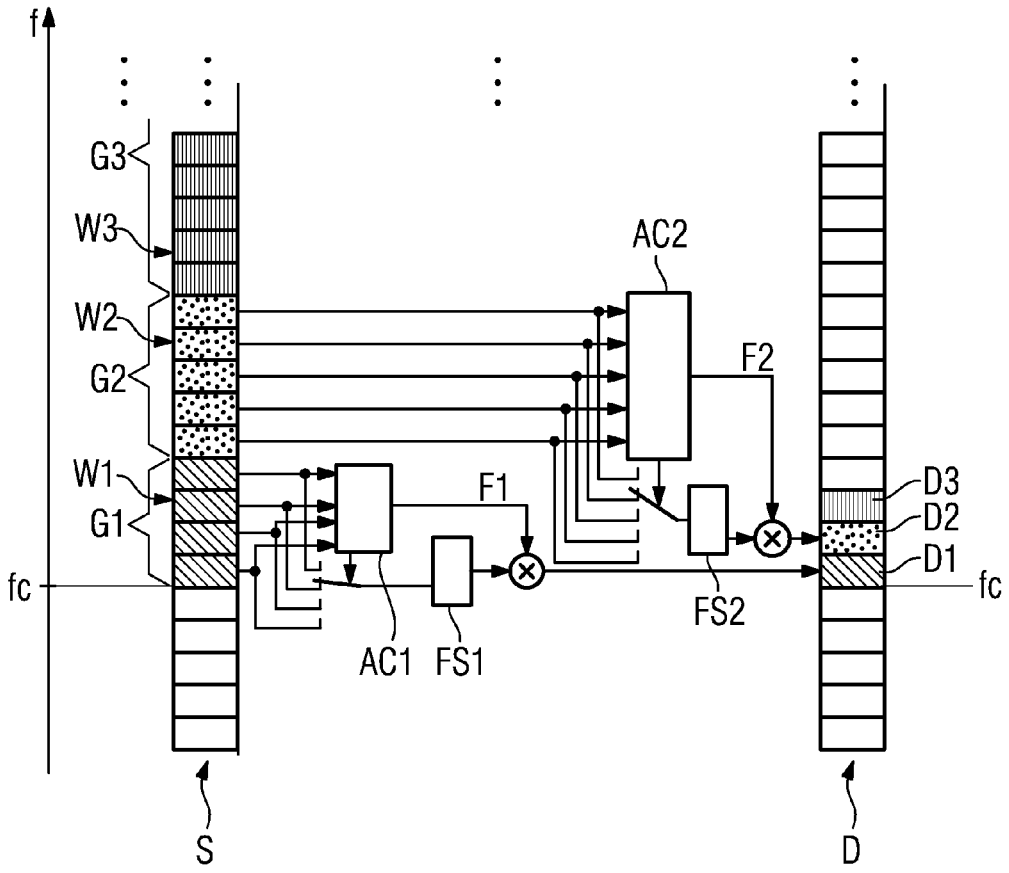
FIG. 3 is a diagram showing the selection of one frequency band from each group of frequency bands and the movement of the selected frequency band in each instance to a target frequency band assigned to the relevant group.

FIG. 3 shows a segment of a block circuit diagram of an inventive hearing aid device of relevance to the invention. It first illustrates the splitting of a frequency spectrum that can be transmitted by the hearing aid device or of an input signal into a number of frequency bands, specifically the source frequency bands S. In this process four adjacent frequency bands are combined into a first group G1, five frequency bands adjoining the first group G1 and likewise adjacent to one another being combined to form a second group G2, etc. The signal components of the input signal in the individual frequency bands of the first group G1 are fed to a signal analysis and control unit AC1, the signal components of the input signal in the individual frequency bands of the second group G2 being fed to a signal analysis and control unit AC2, etc. In the respective signal analysis and control unit the signal level in the individual frequency bands is first determined. The frequency band with the highest signal level is in each instance the "winning frequency band" W1, W2, W3, etc. of the relevant group G1, G2, G3, etc and is moved by a frequency shift to a target frequency band D1, D2, D3, etc. assigned to the respective group and mixed with the signal component from the input signal that is in some instances present anyway in the respective target frequency band D1, D2, D3, etc. The two signal components are in particular added together.

Furthermore a form factor F1, F2, etc. is determined in each instance by the respective signal analysis and control units AC1, AC2, etc., this being preferably proportional to the energy of the signal components of the input signal present in the frequency bands of the respective group G1, G2, G3, etc. Calculation methods for determining the form factors F1, F2, etc. are indicated by way of example in the equations E1 to E4. The form factors F1, F2, etc. each serve as a multiplication factor for the selected frequency band of the relevant group or the signal component of the input signal contained therein. In this process multiplication by the form factor F can take place in each instance before the frequency shift or after the frequency shift (as shown in the exemplary embodiment). Multiplication by the form factor F means that even the frequency bands of the relevant group that are not selected can influence the resulting signal in the target frequency band of the group. This allows sound signals, which differ essentially only in the signal components of the suppressed frequency bands of a group, to be distinguished more easily from one another.

A hearing aid device configured to perform an inventive method contains at least one filter bank for splitting a frequency range that can be transmitted by the hearing aid device into a plurality of frequency bands S. It also contains means for dividing certain frequency bands into different groups G1, G2, G3, etc. of frequency bands. The division of the frequency bands can be set and matched to the individual hearing loss of a user for example by programming the hearing aid device. An inventive hearing aid device furthermore contains means for selecting one frequency band W1, W2, etc. from each group G1, G2, G3, etc. of frequency bands as a function of the signal components of an input signal entering the hearing aid device in the individual frequency bands of the respective group G1, G2, G3, etc. of frequency bands. At least one signal analysis and evaluation unit AC1, AC2, etc. is present in the hearing aid device for selection purposes, determining for example the signal levels and/or energy present in the individual channels and setting the frequency band that has the highest signal level and/or the greatest energy for a certain time period as the "winning frequency band" W1, W2, etc. of the respective group G1, G2, G3, etc.

The inventive hearing aid device furthermore contains devices for moving the respectively selected frequency band W1, W2, etc. to a target frequency band D1, D2, D3, etc. In the exemplary embodiment frequency shifting units FS1 and FS2 are present for this purpose, each shifting or moving a certain frequency range to a different frequency range.

Finally the inventive hearing aid device also contains devices for the respective determination of an amplification of a signal component with the input signal lying in the selected frequency band W1, W2, etc. or of a signal originating from the signal component as a function of signal components in frequency bands of the group G1, G2, G3, etc. of frequency bands that are not selected. In the exemplary embodiment, the determination of the form factors F1, F2, etc. is likewise performed by the signal analysis and evaluation units AC1, AC2, etc. to this end.

Figure 4:
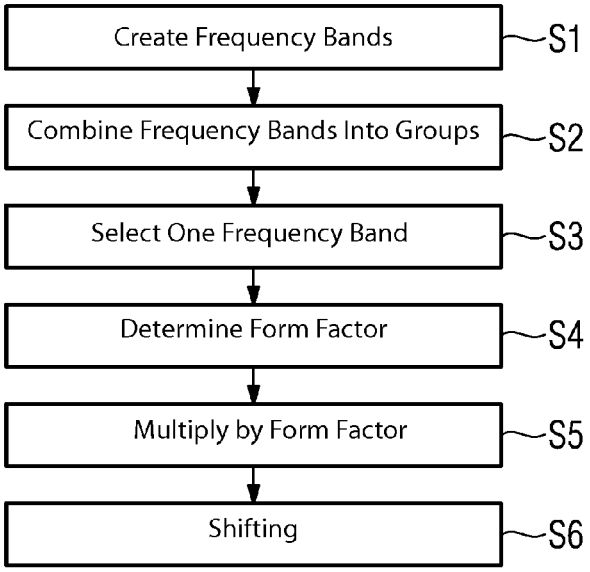
FIG. 4 is a flow diagram showing a performance of an inventive method.

FIG. 4 once again shows graphically the method steps executed in an inventive method during frequency compression of an input signal entering a hearing aid device.

In a first method step S1 a frequency range that can be transmitted by the hearing aid device is split into a number of frequency bands. This causes an input signal entering the hearing aid device to be split into signal components in the respective frequency bands. Then in a method step S2 a number of adjacent frequency bands are respectively combined into at least one group of frequency bands. This is followed in a method step S3 for each group of frequency bands by the selection of one frequency band from the respective group. In method step S4 a form factor is determined for each selected frequency band, with the signal components of the frequency bands of the relevant group of frequency bands that are not selected also being included in its calculation. Then in a method step S5 for each group of frequency bands the signal component in the selected frequency band is multiplied by the form factor determined previously for the relevant group. Multiplication here can take place before or after the shifting of the signal component to the relevant target frequency range (method step S6). The frequency bands of each group that are not selected are not processed further and are therefore suppressed.

The invention claimed is:

1. A method for frequency compression of an input signal entering a hearing aid device, which comprises the steps of:

splitting a frequency range that can be transmitted by the hearing aid device into a number of frequency bands;

combining a number of adjacent frequency bands into at least one group of frequency bands;

selecting one frequency band from the group of frequency bands;

moving a selected frequency band to a target frequency band, where a signal component of the selected frequency band moved to the target frequency band being made audible to a user; and amplifying the signal component of an input signal lying in the selected frequency band or of a signal originating from the signal component in dependence on a further signal component of a further input signal from at least one frequency band that was not selected from of the group of frequency bands.

2. The method according to claim 1, which further comprises determining an amplification of the signal component moved from the selected frequency band to the target frequency band.

3. The method according to claim 1, which further comprises selecting the frequency band with a greatest sound energy and/or a highest signal level within the group of frequency bands.

4. The method according to claim 1, which further comprises multiplying the signal component lying in the selected frequency band or the signal originating from the signal component by a form factor, which is dependent on the further signal component of the further input signal from the frequency band of the group of frequency bands that is not selected.

5. The method according to claim 4, wherein one of the following equations is included in a calculation of the form factor:

$$FA = \frac{\text{Sum of the magnitudes of the signals of all the frequency bands of a group}}{\text{Magnitude of the signal of the selected frequency band}};$$

$$FB = \frac{\text{Sum of the squares of the magnitudes of the signals of all the frequency bands of a group}}{\text{Square of the magnitude of the signal of the selected frequency band}};$$

$$FC = \frac{\text{Sum of the magnitudes of the signals of all the frequency bands of a group}}{(\text{Number of frequency bands})\cdot(\text{Magnitude of the signal of the selected frequency band})};$$

and $$FD = \frac{\text{Sum of the squares of the magnitudes of the signals of all the frequency bands of a group}}{(\text{Number of frequency bands})\cdot\left(\text{Square of the magnitude of the signal of the selected frequency band}\right)}.$$

6. The method according to claim 4, wherein the form factor influences an amplification that is significant for the selected frequency band or the target frequency band of the selected frequency band.

7. The method according to claim 4, wherein the form factor is determined for each group of frequency bands.

8. A hearing aid device for performing a method for frequency compression of an input signal entering a hearing aid device, the hearing aid device comprising:

a filter bank for splitting a frequency range that can be transmitted by the hearing aid device into a plurality of frequency bands;

means for dividing certain frequency bands into different groups of frequency bands;

means for selecting one selected frequency band from each group of frequency bands in dependence on signal components of an input signal entering the hearing aid device in individual frequency bands of a respective group of frequency bands;

means for moving the selected frequency band to a target frequency band, where a signal component of the selected frequency band from each of the groups of frequency bands moved to the target frequency band being made audible to a user; and means for respectively determining an amplification of the signal component of the input signal lying in the selected frequency band or of a signal originating from said signal component in dependence on a signal component of the input signal in at least one frequency band that was not selected from the group of frequency bands.

* * * * *

UNITED STATES PATENT AND TRADEMARK OFFICE

CERTIFICATE OF CORRECTION

PATENT NO. : 8,855,342 B2
APPLICATION NO. : 13/248165
DATED : October 7, 2014
INVENTOR(S) : Ulrich Kornagel It is certified that error appears in the above-identified patent and that said Letters Patent is hereby corrected as shown below:

IN THE CLAIMS

Column 7

Claim 1, line 66, "one frequency band that was not selected from of the" should read -- one frequency band that was not selected from the --

Signed and Sealed this
Sixth Day of January, 2015

Michelle K. Lee

Michelle K. Lee
*Deputy Director of the United States Patent and Trademark Office*